US011485041B2

(12) United States Patent
Raczki

(10) Patent No.: US 11,485,041 B2
(45) Date of Patent: Nov. 1, 2022

(54) TABLE SAW JIG

(71) Applicant: Robert Raczki, Prince George (CA)

(72) Inventor: Robert Raczki, Prince George (CA)

( * ) Notice: Subject to any disclaimer, the term of this patent is extended or adjusted under 35 U.S.C. 154(b) by 0 days.

(21) Appl. No.: 17/396,872

(22) Filed: Aug. 9, 2021

(65) Prior Publication Data

US 2022/0063124 A1 Mar. 3, 2022

Related U.S. Application Data

(60) Provisional application No. 63/071,017, filed on Aug. 27, 2020.

(51) Int. Cl.
*B27B 27/08* (2006.01)

(52) U.S. Cl.
CPC ..... *B27B 27/08* (2013.01)

(58) Field of Classification Search
CPC ..... B27B 25/10; B27B 25/02; B27C 5/06; B27G 19/02; B27G 21/00; B26D 7/22; Y10T 83/745; Y10T 83/744; Y10T 83/6638; Y10T 83/6572; Y10T 83/747
USPC ..... 83/468.7, 446, 447–450, 438, 522.19, 83/455, 522, 743, 745; 144/253.8, 253.1, 144/273.6, 253.5; 30/376; 33/471, 465, 33/466
See application file for complete search history.

(56) References Cited

U.S. PATENT DOCUMENTS 3,901,498 A * 8/1975 Novak ..... B27G 5/023 269/319
4,441,394 A * 4/1984 Barsotti ..... B23D 47/025 83/477.1
4,608,761 A * 9/1986 Small ..... B23Q 9/0092 30/376
4,693,156 A * 9/1987 Olvera ..... B27B 25/10 269/304
5,000,237 A * 3/1991 Berkeley ..... B23Q 3/002 144/251.2
5,293,801 A * 3/1994 Dritenbas ..... B27G 5/023 83/486.1
5,293,802 A * 3/1994 Shiotani ..... B27B 27/02 83/477.2
9,718,207 B2 * 8/2017 Lilholt ..... B27B 11/02
2001/0034951 A1 * 11/2001 Sears ..... B23Q 3/186 33/645

FOREIGN PATENT DOCUMENTS

WO WO 2014/066927 * 5/2014 ..... B28D 1/043

* cited by examiner

*Primary Examiner* — Ghassem Alie
(74) *Attorney, Agent, or Firm* — Brennan, Manna & Diamond, LLC

(57) ABSTRACT

The present invention relates to a table saw jig. The table saw jig is designed to enable accurate straight or angled cuts in a wooden workpiece. The jig features a flat or planar base plate and several pre-drilled holes at specific angles. The jig also includes an adjustable guide rail that is secured to a pair of symmetrically opposed pre-drilled holes and can be used for making accurate and repeatable cuts. A wood piece can be positioned along a rip fence of the guiderail allowing the wood piece to horizontally slide to facilitate accurate and repeatable cuts. The table saw jig reduces the time required to precut stocks as well as the amount of waste material produced during the cabinetry and woodworking process.

20 Claims, 4 Drawing Sheets

TABLE SAW JIG

CROSS-REFERENCE TO RELATED APPLICATION

The present application claims priority to, and the benefit of, U.S. Provisional Application No. 63/071,017, which was filed on Aug. 27, 2020 and is incorporated herein by reference in its entirety.

FIELD OF THE INVENTION

The present invention relates generally to the field of table saws. More specifically, the present invention relates to a table saw jig that eliminates wastage of wood during cutting, ripping and joining of wooden workpieces and saves extensive time and effort of a machine or saw operator. The table saw jig comprises an adjustable guiderail that is designed to be rotatable on a base plate and fastened to pre-drilled holes in a desired direction using mechanical screws. The table saw jig can be used for making accurate, repeatable cuts, and enables users to easily adjust the table saw for maximizing efficiency and accuracy when cutting wood materials. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, many woodworking methods such as routing, ripping and cutting involve the step of moving a wooden workpiece past a rotating table saw. These operations are typically performed on a woodworking machine such as a table saw. A table saw is a power tool commonly used by operators, craftsmen and woodworkers. A saw consisting of a circular saw blade and driven by an electric motor is used for making cuts, rips and other altering shapes of wood pieces. The circular blade protrudes through the surface of a table at a selectable height, wherein the table provides support for the material (usually wood) being cut.

When performing a woodworking operation on a table, the operator needs to control the path of the wooden workpiece as it moves relative to the cutting tool. Further, to make repeated and accurate cuts in a wood piece, woodworkers require a lot of training, experience, and time. Generally, people may lack the experience and also the means to accurately utilize a multipurpose jig to finely cut wood. This can cause a lot of wastage of resources, such as wood and the time of the operator or craftsman. The assisting table jig tools that are available presently are used for typically a specific type of cut or alteration in the wooden workpiece.

Therefore, there exists a long felt need in the art for a jig device that enables accurate straight or angled cuts for cabinetry and other fine woodworking. There is also a long felt need in the art for a jig device that enables multiple types of cuts in a wooden workpiece. Additionally, there is a long felt need in the art for a jig device that eliminates wastage of wood and enables a desired cut in a short span of time with accuracy. Moreover, there is a long felt need in the art for a jig device that can be used with conventional woodworking tables and table saws. Furthermore, there is a long felt need in the art for a jig device that enables stable sliding and movement of a wooden workpiece on the woodworking table. Finally, there is a long felt need in the art for a jig device that laterally stabilizes a wooden workpiece and can be adjusted to facilitate accurate, repeatable cuts or rips for maximizing efficiency and accuracy when cutting wood materials.

The subject matter disclosed and claimed herein, in one embodiment thereof, comprises a table saw jig. The table saw jig is designed to enable accurate straight or angled cuts for cabinetry and other fine woodworking. The table saw jig includes: a base plate; an adjustable guiderail having a horizontal fence and a rip fence; a plurality of pre-drilled holes positioned at specific angles on the base plate; a plurality of base plate fastening holes for selective positioning of the base plate to slide rail; a pair of hex bolts; a flat head cap screw; the adjustable guiderail is secured to a pair of symmetrically opposite-positioned pre-drilled holes using the pair of hex bolts; the adjustable guiderail is further secured using a flat head cap screw positioned near center of the guiderail; and, a wood piece is positioned along the rip fence allowing the wood piece to horizontally slide to facilitate accurate and repeatable cuts.

In this manner, the novel table saw jig of the present invention accomplishes all of the forgoing objectives, and provides a relatively safe, easy and convenient solution to make accurate and repeated cuts or rips on wooden workpieces. The table saw jig device of the present invention is also user-friendly, as it ensures that the wooden workpiece remains stable and does not move during the woodworking process. With this, extensive time and effort is saved when cutting wood and reduces the time required to precut stocks, as well as the amount of waste material produced. The adjustable guiderail of the jig can be used as needed for repeated cuts.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a table saw jig. The table saw jig is designed to enable accurate straight or angled cuts for cabinetry and other fine woodworking. The table saw jig includes: a base plate; an adjustable guiderail having a horizontal fence and a rip fence; a plurality of pre-drilled holes positioned at specific angles on the base plate; a plurality of base plate fastening holes for selective positioning of the base plate to a slide rail; a pair of hex bolts; a flat head cap screw; the adjustable guiderail is secured to a pair of symmetrically opposite positioned pre-drilled holes using the pair of hex bolts; the adjustable guiderail is further secured using a flat head cap screw positioned near the center of the guiderail; and, a wood piece is positioned along the rip fence allowing the wood piece to horizontally slide to facilitate accurate and repeatable cuts.

In a further embodiment of the present invention, a table saw jig with an adjustable guiderail is disclosed. The table saw jig includes: a base plate; a plurality of plate fastening holes for securing the base plate to a slide rail; an adjustable guiderail movable around a central screw and fastened to a pair of symmetrically opposite pre-drilled holes of the base plate in a desired orientation; and, the adjustable guiderail is used for making accurate and repeatable cuts and enables users to adjust the table saw for maximizing efficiency and accuracy when cutting wood materials. The adjustable guiderail is configured to move rotatably on the base plate and a wood piece can be positioned along a rip fence or the horizontal fence. The table saw can be adjusted as per the preferences of an operator enabling accurate and repeatable straight or angled cuts and rips.

In yet another embodiment of the present invention, a method for making accurate straight or angled cuts in a wooden workpiece is described. The method comprises: fastening a table saw jig to a slide rail for selective positioning and sliding movement in a guide slot of a top surface of a woodworking table; fastening an adjustable guiderail with a pair of hex bolts and a flat head cap screw, wherein the pair of hex bolts are fastened to a pair of symmetrically-opposite pre-drilled holes and the flat head cap screw is fastened at the center of the guiderail; positioning a wooden workpiece along a rip fence of the guiderail; and, sliding the workpiece along the rip fence to be cut by the table saw.

In yet another embodiment of the present invention, the base plate is generally rectangular or square in shape and can include dimensions generally from about 1/16" to about 3/8" in height (H), from about 8" to about 16" in length (L), and from about 8" to about 16" in width (W). The adjustable guiderail is secured and rotatable using a screw having a compression spring. The angle of cut is controlled by adjusting the angle of the adjustable guiderail relative to the table saw.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
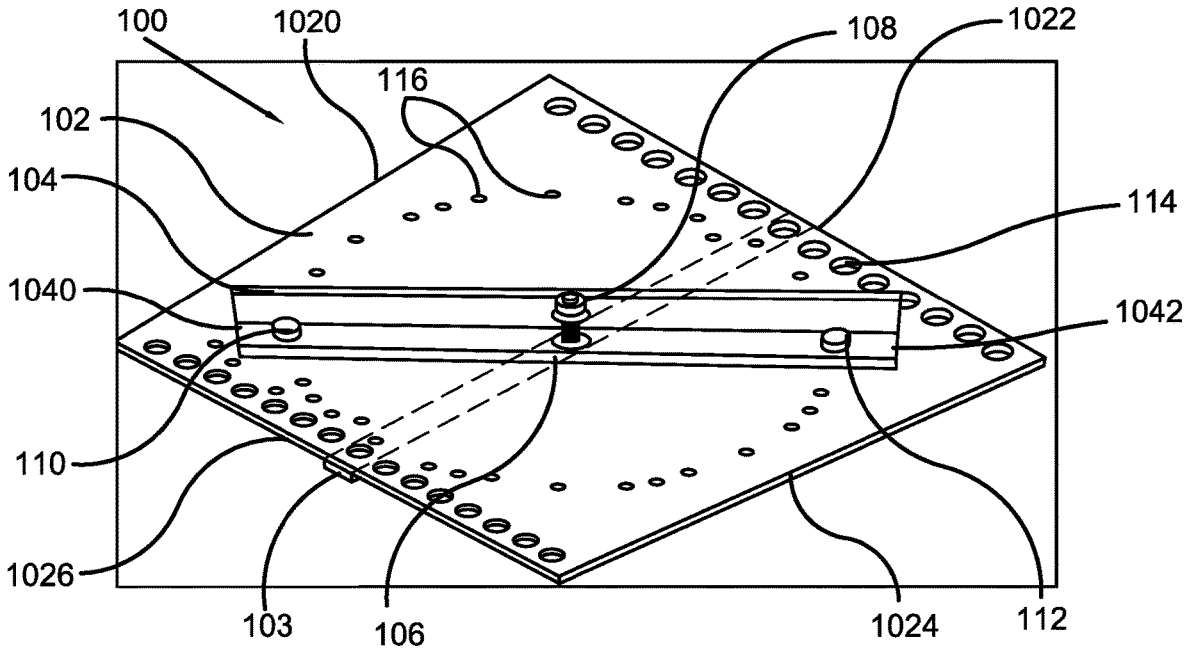
FIG. 1 illustrates a perspective view of one potential embodiment of a table saw jig of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a jig device that enables accurate straight or angled cuts for cabinetry and other fine woodworking. There is also a long felt need in the art for a jig device that enables multiple types of cuts in a wooden workpiece. Additionally, there is a long felt need in the art for a jig device that eliminates wastage of wood, and enables a desired cut in a short span of time with accuracy. Moreover, there is a long felt need in the art for a jig device that can be used with conventional woodworking tables and table saws. Furthermore, there is a long felt need in the art for a jig device that enables stable/accurate sliding and movement of a wooden workpiece on the woodworking table. Finally, there is a long felt need in the art for a jig device that laterally stabilizes a wooden workpiece and can be adjusted to facilitate accurate, repeatable cuts for maximizing efficiency and accuracy when cutting wood materials.

The present invention, in one exemplary embodiment, is a novel table saw jig with an adjustable guiderail. The table saw jig includes a base plate, a plurality of plate fastening holes for securing the base plate to a slide rail or mounting rail, an adjustable guiderail movable around a central screw and is fastened to a pair of symmetrically-opposite pre-drilled holes of the base plate in a desired orientation, the adjustable guiderail is used for making accurate and repeatable cuts and enables users to adjust the table saw for maximizing efficiency and accuracy when cutting wood materials.

Referring initially to the drawings, FIG. 1 illustrates a perspective view of one potential embodiment of table saw jig of the present invention in accordance with the disclosed architecture. The table saw jig 100 of the present invention is configured to enable an operator to make accurate straight or angled cuts for cabinetry and other fine woodworking tasks. The jig 100 is used for controlling a workpiece relative to the blade of a saw during cutting or otherwise altering wood. Further, the jig 100 can be used for steadying a piece of wood being cut to prevent excess cutting or inaccurate cuts.

The table saw jig 100 includes a base plate 102 made up of a metal, plastic or wood. Preferably, the plate 102 is made up of aluminum. The plate 102 can be generally rectangular or square in shape, and the dimensions depend on the size of the table used for the table saw jig 100. The base plate 102 has four edges; a pair of two opposite and parallel edges 1022, 1026 and a second pair of another two opposite and parallel edges 1020, 1024. In one potential embodiment, the plate 102 includes dimensions generally from about 1/16" to about 3/8" in height (H); from about 6" to about 18" in length (L); and, from about 6" to about 18" in width (W). The plate 102 includes a plurality of plate fastening holes 114 along the length of the first pair of parallel edges 1022, 1026 for fastening the flat or planar plate 102 to a slide rail of mounting rail 103. It is to be appreciated that the slide rail is adapted for selective positioning and sliding movement within a guide slot 107 of the woodworking table that includes a circular saw or a cutting tool to cut or give shape to wood.

A guiderail 104 having an alum angle is positioned generally at the center of the base plate 102. The guiderail 104 is fastened to the center 106 of the plate 102 using a ¼" flat head cap or 10-32 screw 108. The screw 108 can be from about 1.0" to about 2.0" long in one potential embodiment allowing the guiderail 104 to be fastened to the base plate 102. For changing orientation of the guiderail 104 on the base plate 102 to allow an operator to make repeatable and accurate straight or angled cuts on a wood, a plurality of holes 116 at specific angles are pre-drilled. The holes 116 can be spaced apart from one another and extend in a generally circular arrangement (i.e. circumscribed) about the base plate. The pre-drilled holes 116 are oriented such that the guiderail 104 can be easily adjusted as per the preferences of the operator. The guiderail 104 is secured to a pair of symmetrically-opposed pre-drilled holes 116 using, for example, ¼" hex bolts or 10-32 bolts. As shown, a first hex bolt 110 fastens the guiderail 104 near a first end 1040 and a second hex bolt 112 fastens the guiderail 104 near a second end 1042. The hex bolts 110, 112 are dimensioned to fit into the pre-drilled holes 116 for securing the guiderail 104 to the flat plate 102 in the desired orientation and angle.

To re-orient the guiderail 104 on the flat plate 102, the hex bolts 110,112 can be unscrewed from one pair of pre-drilled holes, and then can be screwed to another desired pair of pre-drilled holes. The woodworking jig 100 can be used in conjunction with optional clamps or vises to keep the jig 100 securely fastened to the piece of the wood being cut or altered.

The jig 100 can be used by cabinet-makers and joiners in order to facilitate angle-cutting with power saws, circular saws and manual saws. As an example, a rotatable wheel saw can be disposed along the direction of the wood to be cut or disposed. A wood piece can be placed along the guiderail 104 for allowing a saw to cut and alter the piece of wood.

Figure 2:
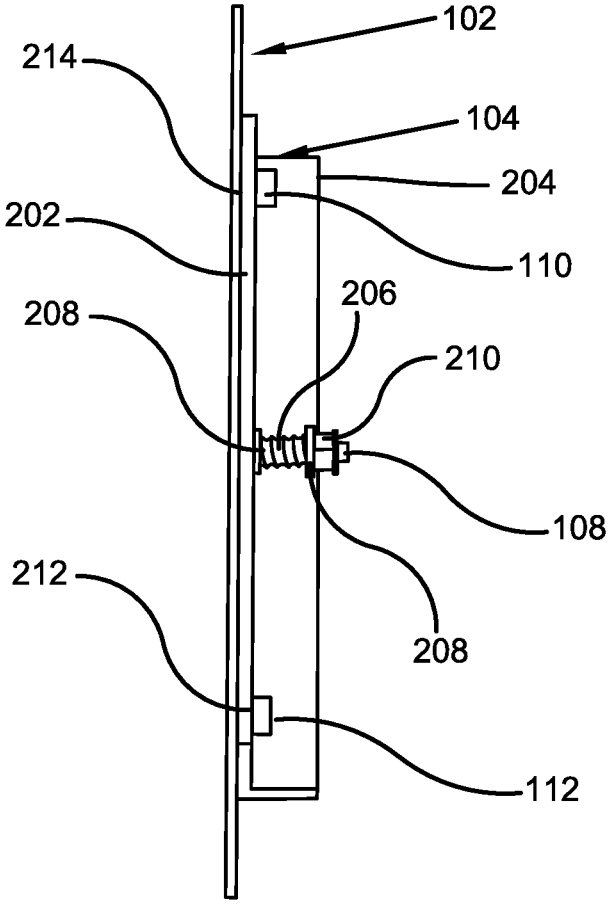
FIG. 2 illustrates a side plan view of one potential embodiment of the table saw jig of the present invention in accordance with the disclosed architecture.

FIG. 2 illustrates a side perspective view of one potential embodiment of the table saw jig of the present invention in accordance with the disclosed architecture. The guiderail 104 includes an alum angle with a horizontal fence 202 placed on the base plate 102 and a rip fence 204 extending vertically from the horizontal fence 202. The horizontal fence 202 can be fastened to the base plate 102 using three mechanical fasteners. A pair of hex bolts 110, 112 can be positioned near the ends of the guiderail 104. The first hex bolt 110 can be is screwed using a lock washer 214 enabling the hex bolt 110 to be secured to a pre-drilled hole of the base plate 102. Similarly, the second hex bolt 112 can be screwed using a second lock washer 212 enabling the second hex bolt 112 to be secured to a symmetrically-opposed pre-drilled hole of the base plate 102.

At the center of the guiderail 104, a flat head cap screw or pivot pin 108 can be used for pivoting (i.e. rotational orientation) and selectively fastening the guiderail 104 to the base plate 102. A pair of flat washers 208 can be used for securing the screw or pivot pin 108. The flat head cap screw 108 includes a compression spring 206 having dimensions generally from about 0.50" to about 1.00" in length (L); from about 0.20" to about 0.50" in outer diameter (OD); and, from about 0.25" to about 0.30" in inner diameter (ID). A nylock nut 210 can be used for screwing and securing the flat head cap screw 108.

The jig 100 can be specifically designed and fitted to be used on standard table saws. The compression spring 206 can also be used to stabilize a piece of wood kept on the horizontal fence 202 and aligned for cutting on the table saw. In one potential embodiment, the compression spring 206 is selected from one of a plurality of compression springs including varying compressive strength characteristics which are suitably sized to laterally stabilize a piece of wood to be cut on a table.

Figure 3:
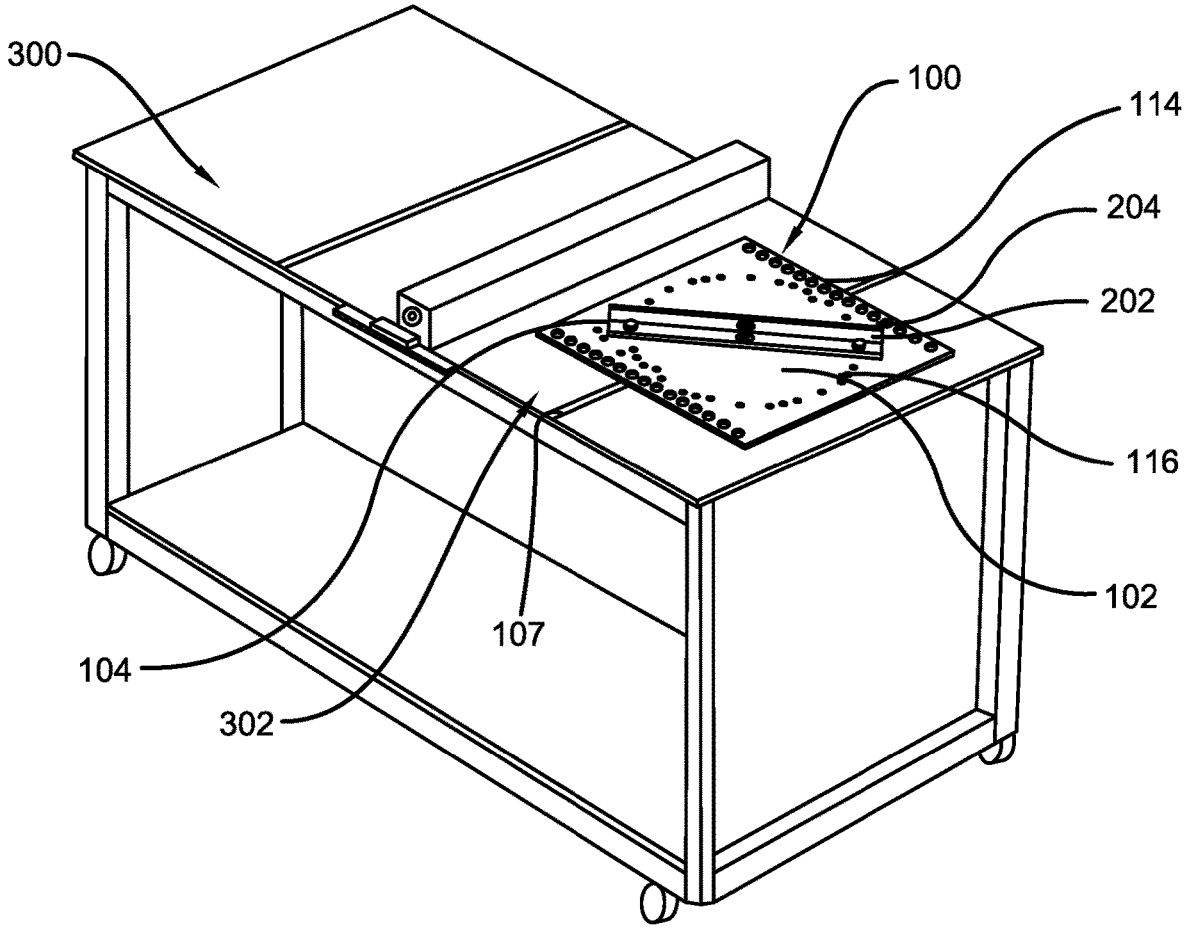
FIG. 3 illustrates a perspective view showing one potential embodiment of the table saw jig of the present invention placed on a woodworking table in accordance with the disclosed architecture.

FIG. 3 illustrates a perspective view showing a table saw jig of the present invention placed on a woodworking table in accordance with the disclosed architecture. The rip fence 204 typically includes an elongated and planar guiding surface which is oriented at a ninety-degree angle to the horizontal fence 202 and top surface 302 of a woodworking table 300, upon which the jig 100 is placed. The horizontal fence 202 can be fastened to the base plate 102 and the base plate 102 can be fastened to the slide rail 103 for selective positioning and sliding movement along guide slot 107 in the top surface 302 using the plate fastening holes 114. A pair of symmetrically-opposed pre-drilled holes 116 can be used for orienting the guiderail 104 on the base plate 102.

The jig with adjustable guiderail 100 of the present invention can be used for horizontally guiding a piece of wood along the rip fence 204. Also, wood pieces can be set up on the horizontal fence 202 using the compression spring 206. The jig 100 can be made in various dimensions, for example scaled up or scaled down, depending on the size of wood pieces to be cut, ripped or altered.

Figure 4:
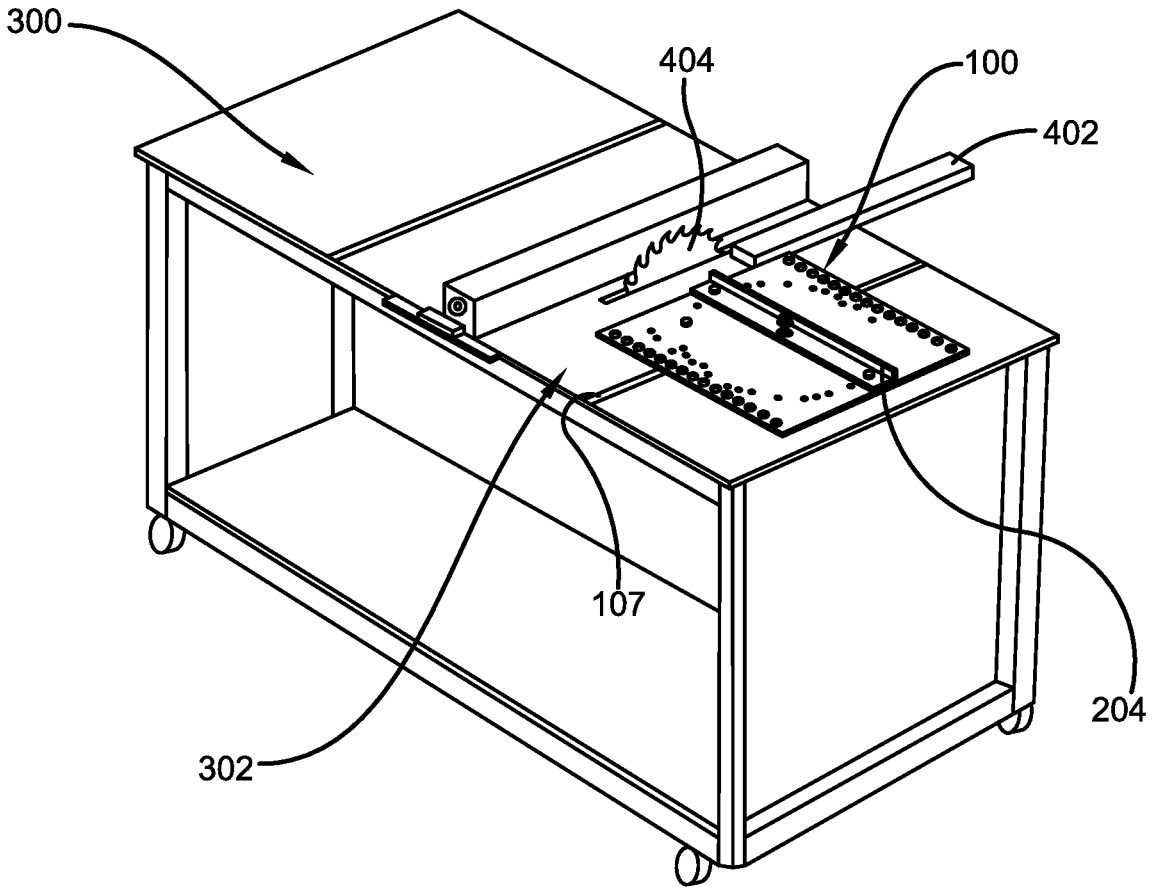
FIG. 4 illustrates a perspective view showing a piece of wood placed along a rip fence of one potential embodiment of the table saw jig of the present invention in accordance with the disclosed architecture.

FIG. 4 illustrates a perspective view showing a wood piece placed along a rip fence of the table jig saw of the present invention for a cut in accordance with the disclosed architecture. As shown, a piece of wood 402 is positioned along the rip fence 204, such that a table saw 404 is positioned to cut through the wood piece 402. During use, the table saw jig 100 can be selectively positioned using a pair of opposing holes 114 and fasteners for mounting to the slide rail 103 and slidingly moved in guide slot 107 along the top surface 302 of a woodworking table 300, thereby allowing an operator to make straight and angled cuts comfortably and accurately. The rip fence 204 provides support to the wood piece 402 wherein the wood piece 402 can be slid horizontally, linearly, and/or laterally to make the desired cut with precision.

The table saw jig 100 can be made available in different sizes (i.e. scales) and colors to accommodate user needs and/or preferences, and the exact size, measurement, construction and design specifications of the jig 100 of the present invention can vary upon manufacturing or the particular material that is used. The base plate 102 of the table saw jig 100 can further comprise logos, indicia, trademarks, geometric patterns, customizable colors and fonts, prints, and/or images on the front surface.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "table saw jig", "jig", "jig with adjustable guiderail", and "table jig" are interchangeable and refer to the table saw jig 100 of the present invention.

Notwithstanding the forgoing, the table saw jig 100 of the present invention can be of any suitable size and configuration as is known in the art without affecting the overall concept of the invention, provided that it accomplishes the above-stated objectives. One of ordinary skill in the art will appreciate that the size, configuration, and material of the table saw jig 100 as shown in the FIGS. are for illustrative purposes only, and that many other sizes and shapes of the table saw jig 100 are well within the scope of the present disclosure. Although the dimensions of the table saw jig 100 are important design parameters for user convenience, the table saw jig 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A table saw jig for aligning a work piece on a table saw surface, the table saw jig comprising:

a base plate, wherein said base plate comprises:

a first pair of opposing edges and a second pair of opposing edges;

a height from about 1/16" to about 3/8", a length from about 6" to about 18", and a width from about 6" to about 18";

a plurality of plate fastening holes extending along a length of at least said first pair of opposing edges for selectively positioning said base plate to a slide rail;

a plurality of spaced apart guiderail mounting holes extending around said base plate for mounting a guiderail to said base plate, wherein said guiderail includes a horizontal fence and a rip fence extending orthogonally to said horizontal fence;

a first fastener extending through at least one selectable horizontal fence hole of said guiderail; and a second fastener extending through at least another selectable horizontal fence hole of said guiderail, wherein said first fastener and said second fastener securable to said base plate, and further wherein said guiderail includes a pivot pin for selective rotational orientation of said guiderail relative to said base plate to selectively align the work piece on the table saw surface; and a mounting rail attached to an underside of the base plate for engaging a guide slot on the table saw surface.

2. The table saw jig of claim 1, wherein said horizontal fence is co-planar with said base plate.

3. The table saw jig of claim 1, wherein said pivot pin further comprises a compression spring therearound, and further wherein said compression spring including a length from about 0.50" to about 1.00", an outer diameter from about 0.20" to about 0.50", and an inner diameter from about 0.25" to about 0.30".

4. The table saw jig of claim 1, wherein said table saw surface includes a circular saw.

5. The table saw jig of claim 1, wherein said base plate is rectilinear.

6. The table saw jig of claim 1, wherein said plurality of spaced apart guiderail mounting holes extend in a circular orientation.

7. The table saw jig of claim 1 further comprising a nylock nut for securing said pivot pin and for fastening said guiderail to said base plate.

8. A table saw jig for aligning a work piece on a table saw surface, the table saw jig comprising:

a rectilinear base plate comprising:

a first pair of opposing edges and a second pair of opposing edges;

a height from about 1/16" to about 3/8", a length from about 6" to about 18", and a width from about 6" to about 18";

a plurality of plate fastening holes extending along a length of at least said first pair of opposing edges for selectively positioning said base plate to a slide rail;

a plurality of spaced apart guiderail mounting holes extending around said base plate for mounting a guiderail to said base plate, wherein said plurality of spaced apart guiderail mounting holes extend in a circular orientation; and the guiderail comprising a horizontal fence and a rip fence extending orthogonally to said horizontal fence, and a pivot pin pivotally connecting a center of the guiderail to a center of the base plate for selective rotational orientation of said guiderail relative to said base plate to selectively align the work piece on the table saw surface; and wherein the guiderail is temporarily securable to the base plate at opposite ends of the guiderail via a pair of the plurality of spaced apart guiderail mounting holes that are symmetrically-opposed to one another.

9. The table saw jig of claim 8, wherein said horizontal fence is co-planar with said base plate.

10. The table jig of claim 8, wherein said pivot pin further includes a compression spring therearound, and further wherein said compression spring including a length from about 0.50" to about 1.00", an outer diameter from about 0.20" to about 0.50", and an inner diameter from about 0.25" to about 0.30".

11. The table saw jig of claim 8, wherein said table saw surface includes a circular saw.

12. The table saw jig of claim 10 further comprising a first fastener extending through at least one selectable horizontal fence hole of said guiderail, and a second fastener extending through at least another selectable horizontal fence hole of said guiderail, wherein said first fastener and said second fastener securable to said base plate.

13. The table saw jig of claim 12 further comprising a nylock nut for securing said pivot pin and for fastening said guiderail to said base plate.

14. The table saw jig of claim 13, wherein said base plate is planar.

15. A table saw jig for aligning a work piece on a table saw surface, the table saw jig comprising:

a rectilinear base plate comprising:

a first pair of opposing edges and a second pair of opposing edges;

a height from about 1/16" to about 3/8", a length from about 6" to about 18", and a width from about 6" to about 18";

a plurality of plate fastening holes extending along a length of at least said first pair of opposing edges for selectively positioning said base plate to a slide rail;

a plurality of guiderail mounting holes extending around said base plate for mounting a guiderail to said base plate, wherein said plurality of guiderail mounting holes extend in a circular orientation;

the guiderail comprising:

a horizontal fence and a rip fence extending orthogonally to said horizontal fence;

a pivot pin for selective rotational orientation of said guiderail relative to said base plate to selectively align the work piece on the table saw surface; and a compression spring positioned around the pivot pin, wherein the compression spring comprises a length from about 0.50" to about 1.00", an outer diameter from about 0.20" to about 0.50", and an inner diameter from about 0.25" to about 0.30"; and wherein the compression spring is configured to secure a piece of wood against the horizontal fence; and wherein the guiderail is temporarily securable to the base plate at opposite ends of the guiderail via a pair of the plurality of guiderail mounting holes that are symmetrically-opposed to one another.

16. The table saw jig of claim 15, wherein said horizontal fence is co-planar with said base plate.

17. The table saw jig of claim 16, wherein said table saw surface includes a circular saw.

18. The table saw jig of claim 17 further comprising a first fastener extending through at least one selectable horizontal fence hole of said guiderail, and a second fastener extending through at least another selectable horizontal fence hole of said guiderail, wherein said first fastener and said second fastener securable to said base plate.

19. The table saw jig of claim 18 further comprising a nylock nut for securing said pivot pin and for fastening said guiderail to said base plate.

20. The table saw jig of claim 19, wherein said base plate is planar.

* * * * *